US006067436A

United States Patent [19]

Kohno et al.

[11] Patent Number: 6,067,436

[45] Date of Patent: May 23, 2000

[54] IMAGE-FORMING MACHINE

[75] Inventors: Hironobu Kohno; Sueaki Okamoto, both of Osaka, Japan

[73] Assignee: Mita Industrial Co., Ltd., Osaka, Japan

[21] Appl. No.: 09/280,052

[22] Filed: Mar. 29, 1999

[30] Foreign Application Priority Data

Mar. 30, 1998 [JP] Japan ..... 10-083487

[51] Int. Cl.[7] ..... G03G 15/01

[52] U.S. Cl. ..... 399/303; 399/297

[58] Field of Search ..... 399/165, 298, 399/299, 301, 302, 303, 306, 308, 313

[56] References Cited

U.S. PATENT DOCUMENTS

| | | | |
|---|---|---|---|
| 5,291,252 | 3/1994 | Kawaishi | 399/313 |
| 5,517,290 | 5/1996 | Marumoto et al. | 399/301 |
| 5,602,634 | 2/1997 | Uchida et al. | 399/313 |

*Primary Examiner*—Arthur T. Grimley
*Assistant Examiner*—Hoang Ngo
*Attorney, Agent, or Firm*—Smith, Gambrell & Russell, LLP

[57] ABSTRACT

An image-forming machine includes an image-forming unit, a transfer belt assembly disposed beneath the image-forming unit so as to freely ascend and descend between an acting position and a non-acting position, and a lift device for asending and descending the transfer belt assembly. The transfer belt assembly includes a driven roller, a tension roller, an endless belt wrapped around the driven roller and the tension roller, and a resilient urging device for resiliently urging the tension roller toward a direction of applying tension to apply tension to the endless belt. A tension release device is disposed which, when the transfer belt assembly is descended to the non-acting position, moves the tension roller in the direction in which tension is no longer applied, against a resilient urging action of the resiliently urging device, so that the application of tension to the endless belt is discontinued. A tension release invalidation device is further disposed to invalidate the tension release action of the tension release device upon detecting the manual operation for drawing out the image-forming unit from a required acting position when the tension release device discontinues the application of tension to the endless belt.

7 Claims, 8 Drawing Sheets

IMAGE-FORMING MACHINE

FIELD OF THE INVENTION

The present invention relates to an image-forming machine equipped with an image-forming unit and a transfer belt means. More specifically, the invention relates to a color image-forming machine capable of selectively forming a color image, though the invention is not limited thereto only.

DESCRIPTION OF THE PRIOR ART

As is widely known among people skilled in the art, there have heretofore been proposed and put into practical use image-forming machines such as printer, copying machine and facsimile and, particularly, color image-forming machines capable of forming color images, which comprises a housing, an image-forming unit arranged in the housing, and a transfer belt means located beneath the image-forming unit. In the color image-forming machine, the image-forming unit includes four image-forming means arranged in tandem, i.e., a black toner image-forming means, a magenta toner image-forming means, a cyan toner image-forming means and a yellow toner image-forming means. Each of these image-forming means is provided with a rotary drum having an electrostatic photosensitive material disposed on the peripheral surface thereof. A color image is formed by forming a black toner image, a magenta toner image, a cyan toner image and a yellow toner image on the rotary drums of the four image-forming means. A transfer belt means usually includes a driven roller, a tension roller, an endless belt wrapped round these rollers as well as four transfer rollers which are a black toner image transfer roller, a magenta toner image transfer roller, a cyan toner image transfer roller and a yellow toner image transfer roller. The tension roller is equipped with a resilient urging means for resiliently urging the tension roller in a direction in which the tension is applied to the endless belt. The four transfer rollers are positioned being opposed to the rotary drums of the four image-forming means while interposing the endless belt, and bring the endless belt into contact with, or close to, the rotary drums of the four image-forming means. A sheet member which may be a common paper is fed onto the endless belt of the transfer belt means, conveyed through between each of the four image-forming means and the endless belt, and during this step, the black toner image, magenta toner image, cyan toner image and yellow toner image are successively transferred onto the sheet member from the rotary drums of the image-forming means, so that a color image is formed on the sheet member.

From the standpoint of replenishing the toner that is consumed and removing the jammed sheet members, the image-forming unit is usually so mounted in the housing as to freely move between an acting position and a non-acting position which is drawn forward or sideward substantially horizontally from the acting position. The endless belt means includes a lift frame that freely ascends and descends between the acting position and the non-acting position lowered from the acting position. The lift frame is equipped with a lift means. The driven roller, tension roller and four transfer rollers are mounted on the lift frame. When the lift frame is located at the acting position, the transfer belt means is located beneath the image-forming unit and works in cooperation with the image-forming unit. In drawing out the image-forming unit from the acting position to the non-acting position, the lift frame is lowered to the non-acting position and the transfer belt means is brought to the non-acting position where it is downwardly separated away from the image-forming unit.

However, the above-mentioned conventional image-forming machine has the following problems that must be solved.

Firstly, tension is applied to the endless belt of the transfer belt means even when the image-forming machine is not in operation, causing the life of the endless belt to be shortened.

Secondly, in order to solve the above-mentioned problem, it is desired that the tension to the endless belt is liberated when the image-forming machine is not in operation and the transfer belt means is located at the non-acting position. However, when attempt is made so as not to apply the tension to the endless belt whenever the transfer belt means is located at the non-acting position, there arouses another problem. That is, when no tension is applied to the endless belt, the upper running part of the endless belt tends to swell upward due to the stiffness of the endless belt itself. At the time of drawing the image-forming unit from the acting position to the non-acting position, therefore, the image-forming unit interferes with the endless belt to damage it.

SUMMARY OF THE INVENTION

It is therefore a first object of the present invention to provide a novel and improved image-forming machine which automatically discontinues the application of tension to the endless belt when the transfer belt means descends to the non-acting position, enabling the life of the endless belt to be lengthened.

It is a second object of the present invention to provide a novel and improved image-forming machine which automatically applies tension to the endless belt when a manual operation is executed to draw the image-forming unit from the acting position to the non-acting position in a state where the transfer belt means is descended to the non-acting position, making it possible to reliably avoid such an occurrence that the image-forming unit interferes with the endless belt at the time when the image-forming unit is drawn out.

In order to accomplish the above-mentioned first object according to the present invention, there is provided an image-forming machine comprising a housing, an image-forming unit arranged in said housing, a transfer belt means located beneath said image-forming unit and arranged in said housing so as to freely ascend and descend between an acting position where it works in cooperation with said image-forming unit and a non-acting position where it is descended from said acting position and is separated away from said image-forming unit, and a lift means for ascending and descending said transfer belt means;

wherein said transfer belt means includes a lift frame which freely ascends and descends between said acting position and said non-acting position, a driven roller rotatably mounted on said lift frame, a tension roller rotatably mounted on said lift frame, an endless belt wrapped round said driven roller and said tension roller, and a resilient urging means, and wherein said tension roller is mounted on said lift frame so as to freely move in a direction in which the tension is applied to said endless belt and in the opposite direction in which no tension is applied thereto, and said resilient urging means resiliently urges said tension roller toward the direction in which the tension is applied to said endless belt;

wherein said image-forming machine further comprises a tension release means which, when said lift frame is descended to said non-acting position by said lift means, moves said tension roller toward a direction in which the tension is no longer applied, against the resilient urging action of said resilient urging means, so that no tension is applied to said endless belt.

In order to accomplish the above-mentioned second object according to the present invention, there is provided an image-forming machine comprising a housing, an image-forming unit arranged in said housing so as to freely move between an acting position and a non-acting position substantially horizontally drawn from said acting position, a transfer belt means located beneath said image-forming unit and arranged in said housing so as to freely ascend and descend between an acting position where it works in cooperation with said image-forming unit and a non-acting position where it is descended from said acting position and is separated away from said image-forming unit when said image-forming unit is located at said acting position, and a lift means for ascending and descending said transfer belt means;

wherein said transfer belt means includes a lift frame which freely ascends and descends between said acting position and said non-acting position, a driven roller rotatably mounted on said lift frame, a tension roller rotatably mounted on said lift frame, an endless belt wrapped round said driven roller and said tension roller, and a resilient urging means, and wherein said tension roller is mounted on said lift frame so as to freely move in a direction in which the tension is applied to said endless belt and in the opposite direction in which no tension is applied thereto, and said resilient urging means resiliently urges said tension roller toward the direction in which the tension is applied to said endless belt;

wherein said image-forming machine further comprises a tension release means which, when said lift frame is descended to said non-acting position by said lift means, moves said tension roller toward a direction in which the tension is no longer applied, against the resilient urging action of said resilient urging means, so that no tension is applied to said endless belt; and a tension release invalidation means which detects the manual operation that is executed for drawing out said image-forming unit from said acting position when said tension release means discontinues the application of tension to said endless belt, and invalidates the tension release action of said tension release means.

Preferably, the lift means is constituted by cam members that are mounted to freely turn between an ascent angular position at where said lift frame is ascended to said acting position and a descent angular position at where said lift frame is descended to said non-acting position, and a turn means for turning said cam members, said lift frame is provided with moving members which move in a direction for applying tension and in a direction for discontinuing the application of tension, said tension roller is rotatably mounted on said moving members, said resilient urging means resiliently urges said moving members toward a direction in which the tension is applied, said tension release means is constituted by an engaging means attached to said cam members and to-be-engaged means formed in said moving members, said engaging means engage with said to-be-engaged means to move said moving members in the direction of discontinuing the application of tension while said cam members are turned from said ascent angular position to said descent angular position, and said engaging means are liberated from said to-be-engaged means while said cam members are turned from said descent angular position to said ascent angular position. According to a preferred embodiment, said tension release invalidation means turns said cam members toward said ascent angular position by a predetermined angle, so that said engaging means are separated away from said to-be-engaged means. It is desired that a resilient member is interposed between said cam members and said lift frame, said transfer belt means is provided with contact means, said image-forming unit is provided with to-be-contacted means, and said cam members that are turned to said ascent angular position work to depress said contact means of said lift frame onto said to-be-contacted means of said image-forming means via said resilient means. It is desired that the lift frame freely ascends and descends in a substantially vertical direction. In a preferred embodiment, the image-forming unit is provided with a locking means which releasably locks said image-forming unit at said acting position, said locking means freely moves between a locking position and an unlocking position, and said tension release invalidation means detects the manual operation for moving said locking members from said locking position to said unlocking position.

DETAILED DESCRIPTION OF THE PREFERRED EMBODIMENTS

The image-forming machine constituted according to the present invention will be described below in more detail by way of a preferred embodiment with reference to the accompanying drawings.

Figure 1:
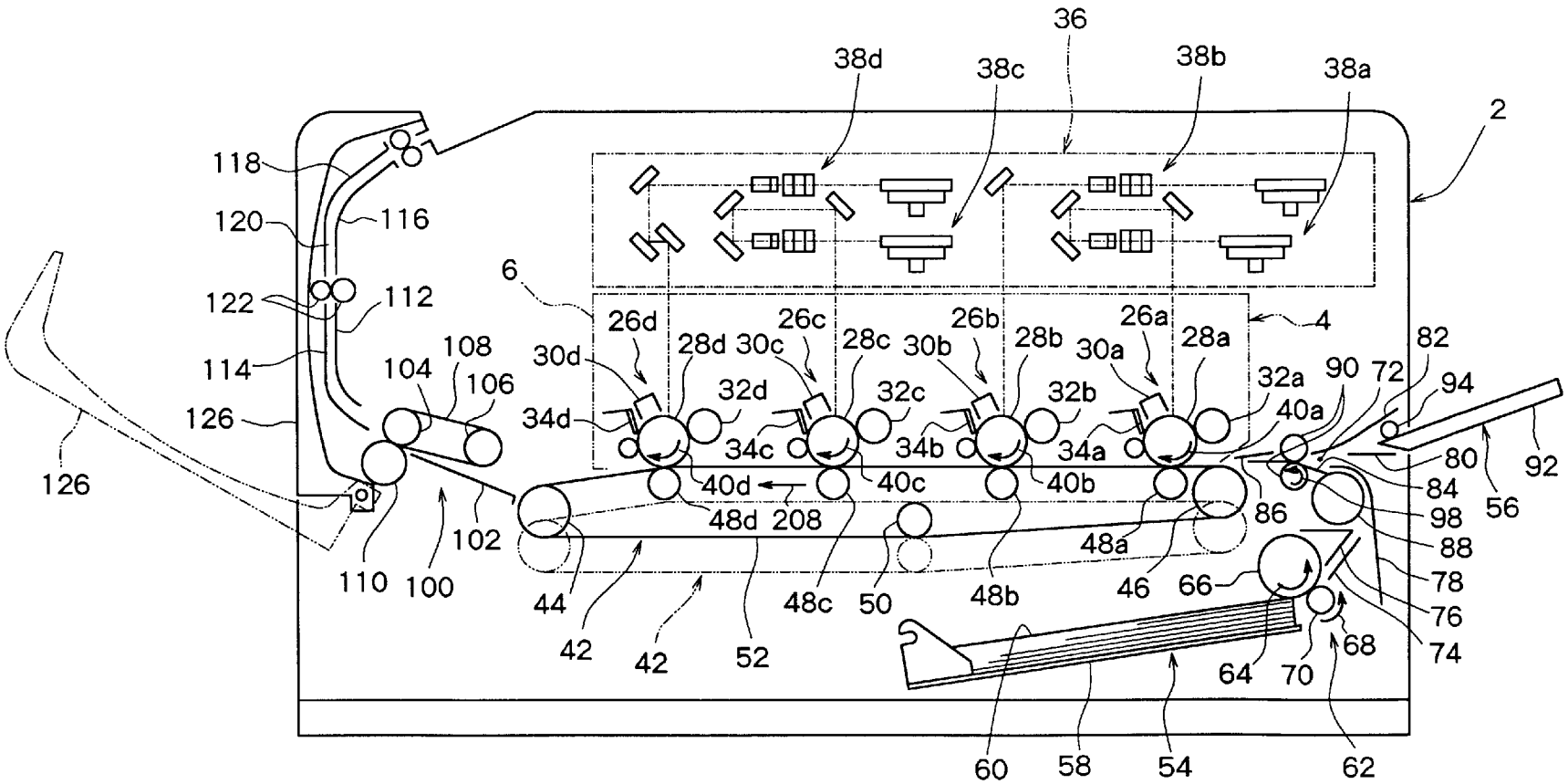
FIG. 1 is a sectional view schematically illustrating the entire image-forming machine constituted according to a preferred embodiment of the present invention.

FIG. 1 schematically illustrates the entire constitution of a color image-forming machine constituted according to the present invention. The illustrated image-forming machine has a housing 2 of nearly a rectangular parallelopiped shape. An image-forming unit 4 is arranged nearly at the central portion of the housing 2. The image-forming unit 4 includes a frame 6 indicated by a two-dotted chain line. The frame 6 is mounted by a suitable mounting means (not shown) such as "Accuride™" and is allowed to freely move substantially horizontally between an acting position and a non-acting position that it is drawn forward in a direction perpendicular to the surface of the paper in FIG. 1 from the acting position in the housing 2.

Figure 2:
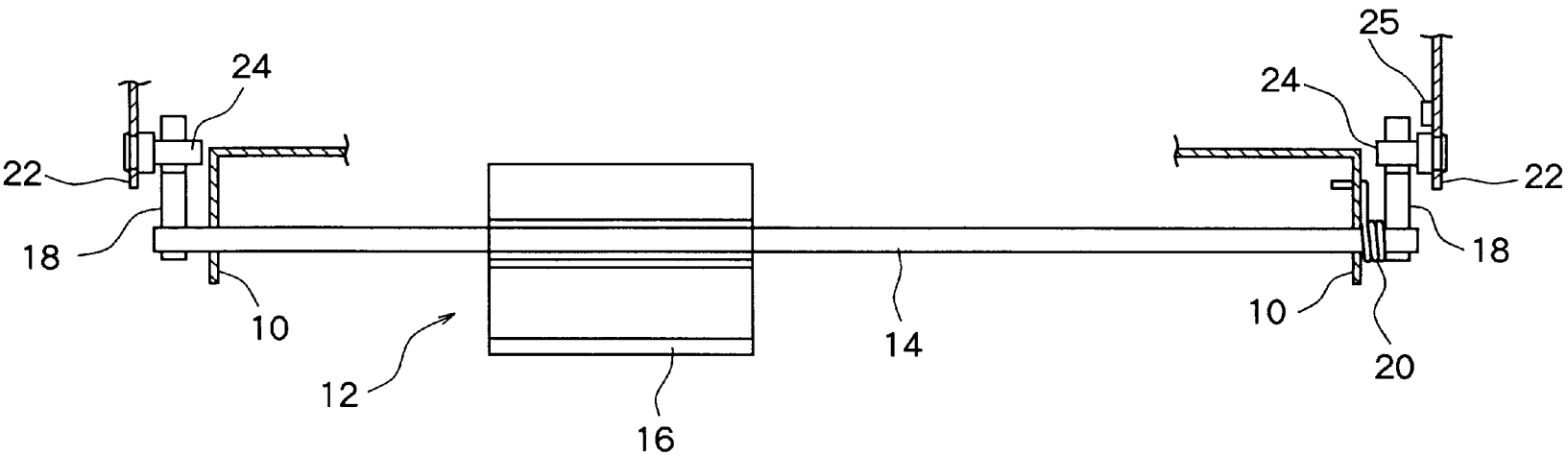
FIG. 2 is a partial plan view illustrating locking means for locking an image-forming unit in the image-forming machine shown in FIG. 1 at an acting position.
Figure 3:
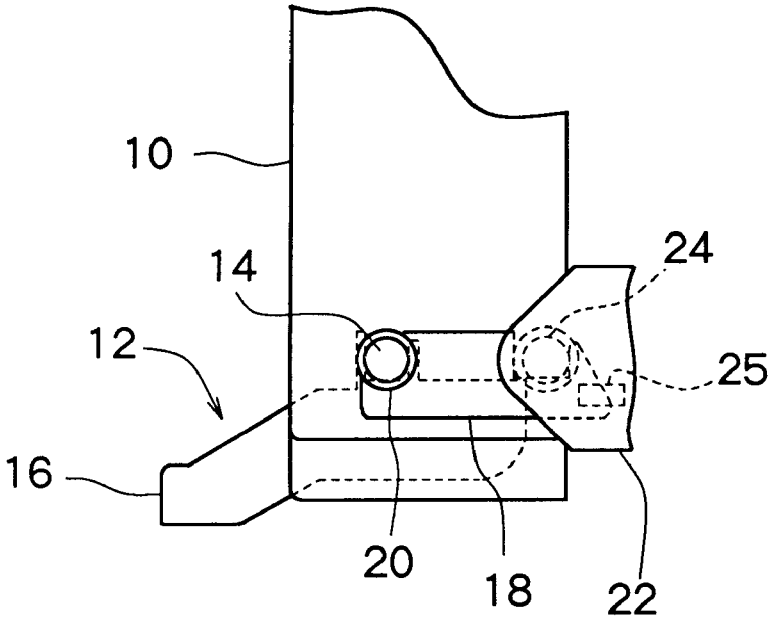
FIG. 3 is a sectional view of the locking means shown in FIG. 2.

Referring to FIGS. 2 and 3, a pair of upright walls 10 are formed, spaced from each other, on the front surface of the frame 6 so as to protrude forward in the transverse direction. A locking means 12 is mounted on the upright walls 10. The locking means 12 is constituted by a rotary shaft 14 rotatably mounted between the upright walls 10, an operation lever 16 secured to the central portion of the rotary shaft 14, and hooks 18 secured to both ends of the rotary shaft 14 that extends beyond the upright walls 10. A coil spring 20 is fitted to one end of the rotary shaft 14 (right end in FIG. 2), the coil spring 20 being secured at its one end to the upright wall 10 and at its other end to the rotary shaft 14 to resiliently urge the rotary shaft 14 in the counterclockwise direction in FIG. 3. The rotary shaft 14, operation lever 16 and hooks 18 are resiliently urged to a locking position indicated by a solid line in FIGS. 2 and 3. A stopper piece (not shown) is disposed on the front surface of the frame 6. When the locking means 12 arrives at the locking position indicated by a solid line in FIGS. 2 and 3, the operation lever 16 comes in contact with the stopper piece, and the locking means 12 is prevented from turning in the counterclockwise direction in FIG. 3 beyond the locking position. As clearly shown in FIG. 3, the rear edge of the hook 18 is downwardly inclined toward the rear side (toward the right in FIG. 3). A pair of upright walls 22 are arranged on the front part of the housing 2 to forwardly protrude on both sides of the frame 6. Lock pins 24 are secured to the upright walls 22. At the time when the frame 6 is moved to the acting position shown in FIGS. 1 to 3 from the non-acting position that is drawn forward from the housing 2 (FIG. 1), the rear edges of the hooks 18 of the locking means 12 come in contact with the lock pins 24, whereby the locking means 12 is slightly turned in the clockwise direction in FIG. 2 against the resilient urging action of the coil spring 20. Then, as the ends of the hooks 18 pass over the lock pins 24, the locking means 12 is caused to turn up to the locking position in the counterclockwise direction in FIG. 3 due to the resilient urging action of the coil spring 20, and the hooks 18 engage with the lock pins 24. Thus, the frame 6 and, hence, the image-forming unit 4 is releasably locked at the acting position. In order to draw out the image-forming unit 4 to the non-acting position, the operation lever 16 of the locking means 12 is turned by a finger in the clockwise direction in FIG. 3 so that the hooks 18 are liberated from the lock pins 24, and then, are pulled forward. A detector 25 is disposed on one of the upright walls 22 (upright wall 22 on the right side in FIG. 2) of the housing 2 to detect the fact that the hook 18 of the locking means 12 is turned in the clockwise direction from the locking position indicated by a solid line in FIG. 3 as a result of operating the operation lever 16. The detector 25 may be an optical detector of the reflection type or a microswitch having a mechanical detection arm. Control function based upon the detection by the detector 25 will be described later.

If further described with reference to FIG. 1, the frame 6 of the image-forming unit 4 is equipped with four image-forming means, i.e., a black toner image-forming means 26*a*, a magenta toner image-forming means 26*b*, a cyan toner image-forming means 26*c* and a yellow toner image-forming means 26*d*. The image-forming means 26*a*, 26*b*, 26*c* and 26*d* include rotary drums 28*a*, 28*b*, 28*c* and 28*d* as well as charging means 30*a*, 30*b*, 30*c* and 30*d*, developing means 32*a*, 32*b*, 32*c* and 32*d*, and cleaning means 34*a*, 34*b*, 34*c* and 34*d* that are respectively arranged surrounding the rotary drums 28*a*, 28*b*, 28*c* and 28*d*. An electrostatic photosensitive material is disposed on the peripheral surfaces of the rotary drums 28*a*, 28*b*, 28*c* and 28*d*. In the housing 2 is further disposed an optical unit 36 located above the image-forming unit 4. The optical unit 36 includes four optical means, i.e., an optical means 38*a* for forming a black toner image, an optical means 38*b* for forming a magenta toner image, an optical means 38*c* for forming a cyan toner image, and an optical means 38 for forming a yellow toner image. The optical means 38*a*, 38*b*, 38*c* and 38*d* may be of any known form including a source of laser beam (not shown), a rotary polygonal mirror for scanning the laser beam, and an optical element such as lens and reflector. To form a black toner image, the peripheral surface of the rotary drum 28*a* rotated in the direction indicated by an arrow 40*a* is electrically charged uniformly by a charging means 30*a*. Then, the electric charge on the peripheral surface of the rotary drum 28*a* is selectively removed by the irradiation with light from the optical means 38*a*, so that an electrostatic latent image is formed on the peripheral surface of the rotary drum 28*a*. Then, the electrostatic latent image is developed into a black toner image by the developing means 32*a*. The black toner image is transferred onto a sheet member in a manner as will be described later. The black toner remaining on the rotary drum 28*a* after the transfer is removed by the cleaning means 34*a*. A magenta toner image, a cyan toner image and a yellow toner image are formed on the rotary drums 28*b*, 28*c* and 28*d* that rotate in the directions indicated by arrows 40*b*, 40*c* and 40*d* in substantially the same manner as described above. The image-forming means 26*a*, 26*b*, 26*c* and 26*d* and the optical means 38*a*, 38*b*, 38*c* and 38*d* may be of known forms, and do not constitute any novel feature of the improved image-forming machine of the present invention. Therefore, these means are not described in this specification.

In the housing 2 is further arranged a transfer belt means 42 which is allowed to freely ascend and descend between an acting position indicated by a solid line in FIG. 1 and a non-acting position indicated by a two-dotted chain line in FIG. 1. The illustrated transfer belt means 42 includes a driven roller 44, a tension roller 46, a black toner image transfer roller 48*a*, a magenta toner image transfer roller 48*b*, a cyan toner image transfer roller 48, a yellow toner image transfer roller 48*d*, an auxiliary roller 50, and an endless belt 52 wrapped around them. When the transfer belt means 42 is brought to the acting position, the transfer rollers 48*a*, 48*b*, 48*c* and 48*d* are positioned being respectively opposed to the rotary drums 28*a*, 28*b*, 28*c* and 28*d* of the image-forming means 26*a*, 26*b*, 26*c* and 26*d*, enabling the endless belt 52 to be brought into contact with (or brought close to) the rotary drums 28*a*, 28*b*, 28*c* and 28*d*. When the transfer belt means 42 is descended from the acting position to the non-acting position, on the other hand, the endless belt 52 is downwardly separated away from the rotary drums 28*a*, 28*b*, 28*c* and 28*d* of the image-forming means 26*a*, 26*b*, 26*c* and 26*d*. The transfer belt means 42 will be described later in further detail.

If further described with reference to FIG. 1, a first sheet member-feeding means 54 and a second sheet member-feeding means 56 are disposed in the illustrated image-forming machine. The first sheet member-feeding means 54 includes a sheet member-placing plate 58 on which will be placed a plurality of pieces of sheet members 60, and a sheet member-sending means 62 for sending the sheet members 60 piece by piece from the placing plate 58. The sheet member-sending means 62 is constituted by a sending roller 66 that is rotated in the direction indicated by an arrow 64 and a separation roller 70 that is rotated in the direction indicated by an arrow 68. The sheet member 60 fed from the first sheet member-feeding means 54 is fed to the transfer belt means 42 through a conveyer passage 72. The conveyer passage 72 is defined by guide plates 74, 76, 78, 80, 82, 84 and 86. In the conveyer passage 72 are disposed a conveyer roller 88 and a pair of resist rollers 90. The second sheet member-feeding means 56 includes a sheet member-placing plate 92 on which will be placed a plurality of pieces of sheet members 60, and a sending roller 94 for sending the sheet members 60 piece by piece from the placing plate 92. The sheet member 60 sent from the second sheet member-feeding means 56 is fed to the pair of resist rollers 90 passing through between the guide plates 80 and 82. The pair of resist rollers 90 are rotated in the direction indicated by an arrow 98 in synchronism with the operations of the image-forming means 26*a*, 26*b*, 26*c* and 26*d*, and feed the sheet member 60 from the first sheet member-feeding means 54 or the second sheet member-feeding means 56 to the transfer belt means 42 or, more specifically, to between the endless belt 52 of the transfer belt means 42 at the acting position indicated by a solid line and the rotary drums 28*a*, 28*b*, 28*c* and 28*d* of the image-forming means 26*a*, 26*b*, 26*c* and 26*d*. The first sheet member-feeding means 54 and the second sheet member-feeding means 56 may be of known forms, and are not described in detail in this specification.

A fixing means 100 is disposed on the downstream side of the transfer belt means 42, and a guide plate 102 is disposed between the fixing means 100 and the transfer belt means 42. The fixing means 100 which may be of a known form is constituted by an endless belt 108 wrapped round a heating roller 104 and a driven roller 106, and a pushing roller 110. A discharge passage 120 is defined by guide plates 112, 114, 116 and 118 on the downstream side of the fixing means 100, and a pair of conveyer rollers 122 are disposed in the discharge passage 120. The discharge passage 120 extends up to a receiving portion formed on the upper surface of the housing 2. In the illustrated image-forming machine, furthermore, a receiving dish 126 is provided so as to be selectively located at a non-acting position indicated by a solid line and an acting position indicated by a two-dotted chain line. Between the fixing means 100 and the discharge passage 120, there is provided a discharge direction change-over means (to simplify the drawing, the discharge direction change-over means is not illustrated) in order to selectively guide the sheet member 60 sent from the fixing means 100 to either the discharge passage 120 or the receiving dish 126 located at the acting position.

To form a color image by using the above-mentioned image-forming machine, the sheet member 60 sent from the first sheet member-feeding device 54 or the second sheet member-feeding means 56 is allowed to pass through between the image-forming unit 4 and the transfer belt means 42. At this moment, there are successively transferred onto the sheet member 60 a black toner image from the rotary drum 28*a* of the image-forming means 26*a*, a magenta toner image from the rotary drum 28*b* of the image-forming means 26*b*, a cyan toner image from the rotary drum 28*c* of the image-forming means 26*c*, and a yellow toner image from the rotary drum 28*d* of the image-forming means 26*d*. Thus, a color image is formed on the sheet member 60. The color image is fixed on the sheet member 60 in the fixing means. Thereafter, the sheet member 60 is discharged through the discharge passage 120 onto the receiving portion formed on the upper surface of the housing 2 or onto the receiving dish 126 located at the acting position indicated by the two-dotted chain line. When the black image is to be formed on the sheet member 60, the black toner image is transferred onto the sheet member 60 from the rotary drum 28*a*. Here, however, the toner image is not transferred onto the sheet member 60 from the rotary drums 28*b*, 28*c* and 28*d* of the other image-forming means 26*b*, 26*c* and 26*d* (in this case, the transfer rollers 48*b*, 48*c* and 48*d* of the transfer belt means 42 are retracted to be slightly lower than the positions indicated by the solid lines as will be described later in further detail).

Figure 4:
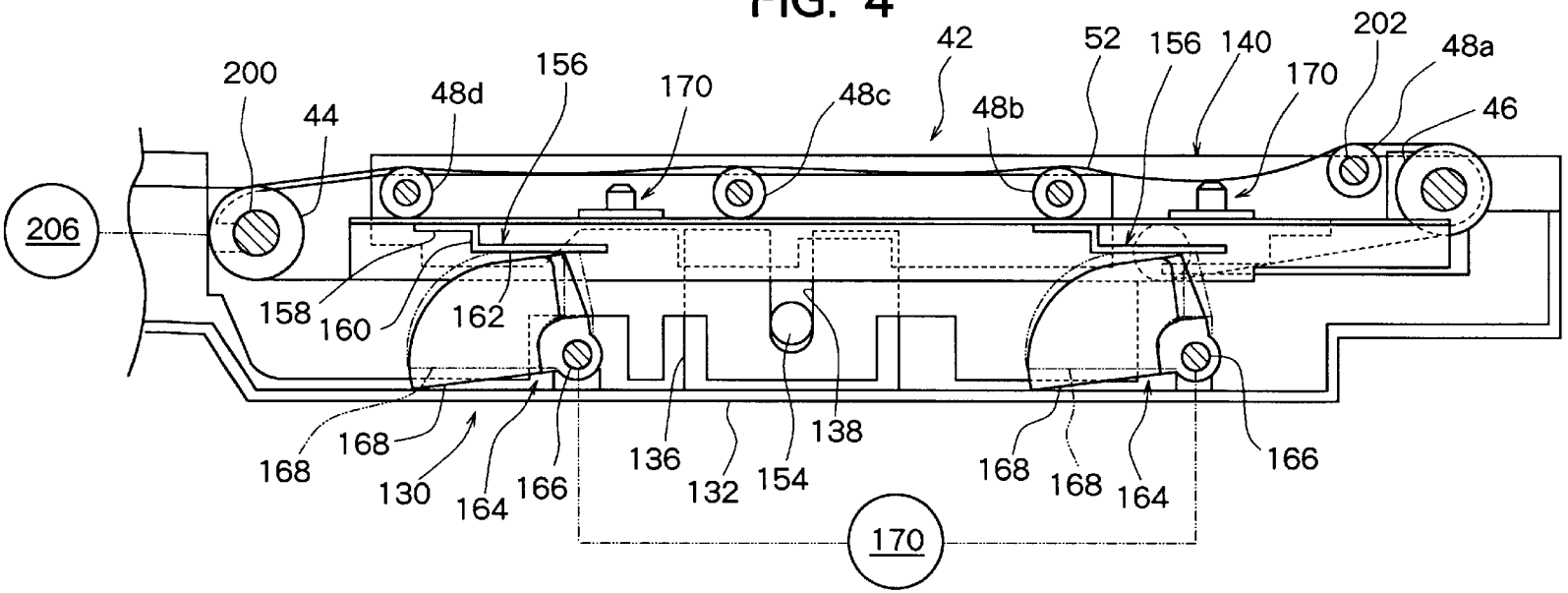
FIG. 4 is a sectional view schematically illustrating a state where a transfer belt means in the image-forming machine shown in FIG. 1 is descended to a non-acting position.
Figure 5:
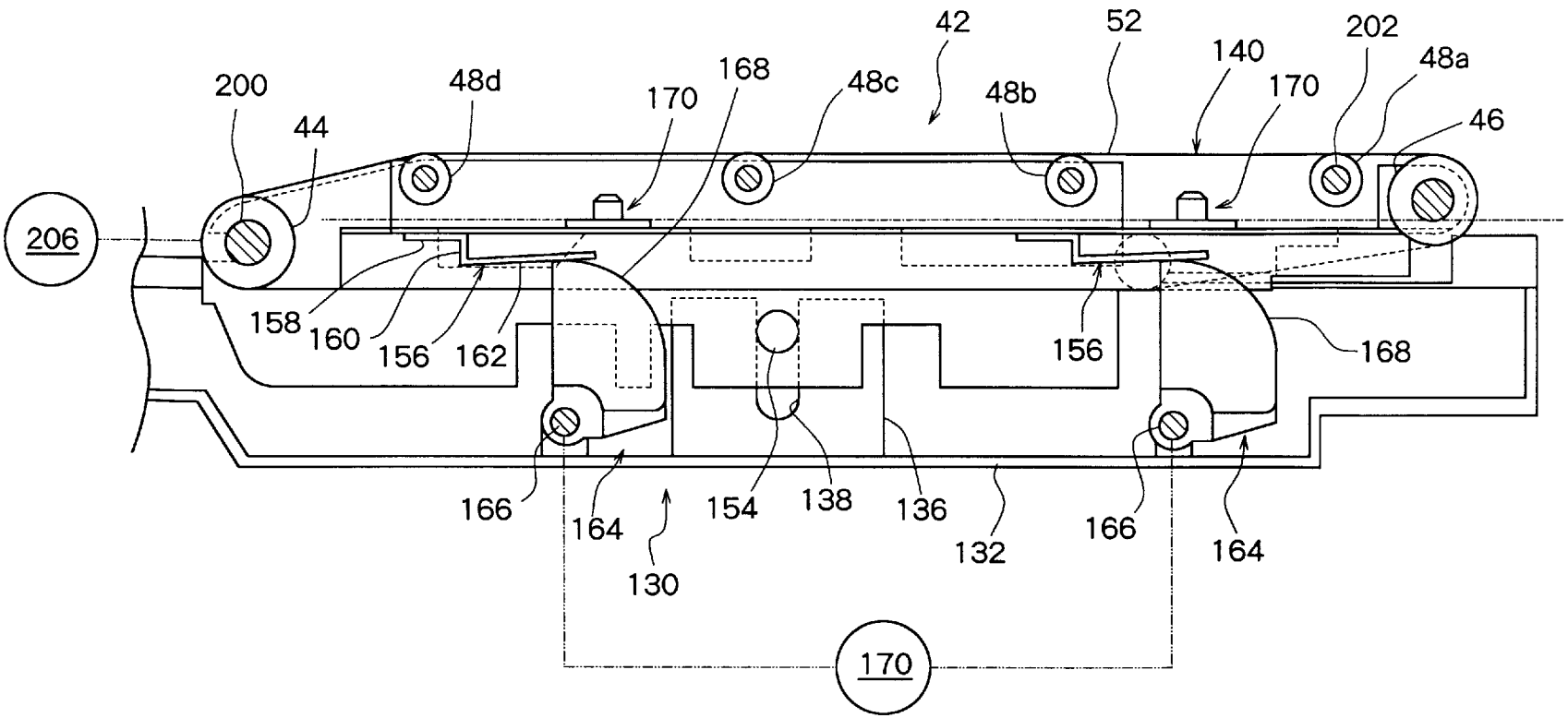
FIG. 5 is a sectional view schematically illustrating a state where the transfer belt means in the image-forming machine shown in FIG. 1 is ascended to the acting position.

If described with reference to FIG. 1 together with FIGS. 4 to 6, a mounting frame 130 is secured at a predetermined position in the housing 2 by a suitable securing means (not shown). The mounting frame 130 that can be formed of a suitable synthetic resin has a bottom wall 132 and both side walls 134 (FIG. 6) that extend upward substantially vertically from both side edges of the bottom wall 132. On the mounting frame 130 are further formed a pair of guide walls 136 that extend upward substantially vertically from the bottom wall 132 on the insides of both side walls 134. A guide slit 138 extending downward substantially vertically from the upper edge thereof is formed in each of the guide walls 136, as indicated by a two-dotted chain line in FIGS. 4 and 5.

The above-mentioned transfer belt means 42 is mounted on the mounting frame 130 so as to freely ascend and descend in a substantially vertical direction. If described in further detail with reference to FIGS. 4 to 6, the transfer belt means 42 includes a lift frame 140 that can be formed of a suitable synthetic resin. The lift frame 140 has a bottom wall 142 and both side walls 144 that extend upward substantially vertically from both side edges of the bottom wall 142. As will be understood from FIG. 6, auxiliary members 146 are secured to the outer surfaces of both side walls 144 of the lift frame 140 by suitable fastening means (not shown) such as fastening screws. Each auxiliary member 146 that can be formed of a metal plate has a hanging wall 148 that hangs down beyond the bottom wall 142 of the lift frame 140, a horizontal flange wall 150 that extends substantially horizontally from the side wall 144 of the lift frame 140, and an additional hanging wall 152 that hangs down from the end of the horizontal flange wall 150. A to-be-guided pin 154 that extends substantially horizontally is secured to the hanging wall 148 of each of the auxiliary members 146. The to-be-guided pin 154 is inserted in the guide slit 138 formed in the guide wall 136 of the mounting frame 130. The diameter of the to-be-guided pin 154 is substantially the same as the width of the guide slit 138. As the to-be-guided pin 154 moves along the guide slit 138, the lift frame 140 ascends and descends in a substantially vertical direction relative to the mounting frame 130. Two resilient members 156 are secured to the lower surface of the horizontal flange wall 150 of each of the auxiliary members 146 at a predetermined distance in the lengthwise direction (right-and-left direction in FIGS. 4 and 5). Each resilient member 156 that can be made of a spring steel has an upper horizontal portion 158 secured to the horizontal flange wall 150, a hanging portion 160 that hangs down from the upper horizontal portion 158, and a lower horizontal portion 162 that extends from the lower end of the hanging portion 160.

A lift means 164 is disposed between the mounting frame 130 and the lift frame 140. The lift means 164 will now be described in detail with reference to FIGS. 4 to 6. A pair of cam shafts 166 are rotatably mounted at a distance between the two side walls 134 of the mounting frame 130 in the direction of conveying the sheet members, i.e., in the right-and-left direction in FIGS. 4 and 5. Cam members 168 are secured to both end portions of the cam shafts 166. The pair of cam shafts 166 are coupled to a drive source 170 which may be an electric motor, via a suitable drive coupling means (not shown). The pair of cam shafts 166 and the cam members 168 secured thereto are caused to turn between the descent angular position indicated by a solid line in FIG. 4 and the ascent angular position indicated by a solid line in FIGS. 5 and 6. The cam members 168 that are turned from the descent angular position to the ascent angular position in the clockwise direction in FIGS. 4 and 5, come into contact with the lower horizontal portions 162 of the resilient members 156 secured to the lower surface of the horizontal flange wall 150, so that the lift frame 140 ascends to the ascent position shown in FIGS. 5 and 6 (the ascent position of the lift frame 140 will be further described later). As the cam members 168 are turned in the counterclockwise direction in FIGS. 4 and 5 from the ascent position to a position indicated by a two-dotted chain line in FIG. 4, on the other hand, the lift frame 140 descends to the descent position shown in FIG. 4. At the descent position, the lower edges of the hanging walls 148 of the auxiliary members 146 secured to the lift frame 140 come in contact with the upper surface of the bottom wall 132 of the mounting frame 130. Therefore, the lift frame 140 is prevented from descending any more. Generally, the cam members 168 are turned up to the descent angular position indicated by the solid line in FIG. 4 beyond the position indicated by the two-dotted chain line in FIG. 4, so as to be slightly separated away downward from the resilient members 156 secured to the mounting frame 130 (the reason for turning the cam members 168 beyond the position indicated by the two-dotted chain line will be described later). When the lift frame 140 moves up and down by the cam members 168, the to-be-guided pins 154 move along the guide slits 138, whereby the lift frame 140 is guided to move up and down in substantially a vertical direction.

If further described with reference to FIG. 6 as well as FIG. 7, a pair of position-restricting members 170 are arranged on each horizontal flange wall 150 of the auxiliary members 146 secured to both sides of the lift frame 140, the pair of position-restricting members 170 being arranged at a distance in the direction of conveying the sheet members (right-and-left direction in FIGS. 4 and 5). Therefore, the lift frame 140 has the position-restricting members 170 at the four corners thereof. Each position-restricting member 170 that can be formed of a suitable synthetic resin is constituted by a flat base plate portion 172 secured onto the horizontal flange wall 150 of the auxiliary member 146 by a suitable means such as adhesion or screw, and a protruding portion 174 that upwardly protrudes substantially vertically from the base plate portion 172. As will be understood from the description appearing later, the upper surface of the base plate portion 172 constitutes a contact means. The protruding portion 174 has a circular shape in cross section, and its upper end is tapered. On the other hand, the frame 6 of the image-forming unit 4 has a front wall 176 and a rear wall 178. The front wall 176 and the rear wall 178 are constituted by intermediate wall portions 180 and 182 formed of a suitable synthetic resin, outer wall portions 184 and 186 made of thin metal plates secured to the outer surfaces of the intermediate wall portions 180 and 182, and inner wall portions 188 and 190 made of thin metal plates secured to the inner surfaces of the intermediate wall portions 180 and 182. The lower edges of the inner wall portions 188 and 190 extend substantially horizontally to constitute a to-be-contacted means as will be understood from the description appearing later. Pairs of blind receiving holes 192, 194, 196 and 198 are formed in the intermediate wall portions 180 and 182 at a distance in the direction of conveying the sheet members. The blind receiving holes 192, 194, 196 and 198 extend upward substantially vertically from the lower surfaces of the intermediate walls 180 and 182.

Figure 6:
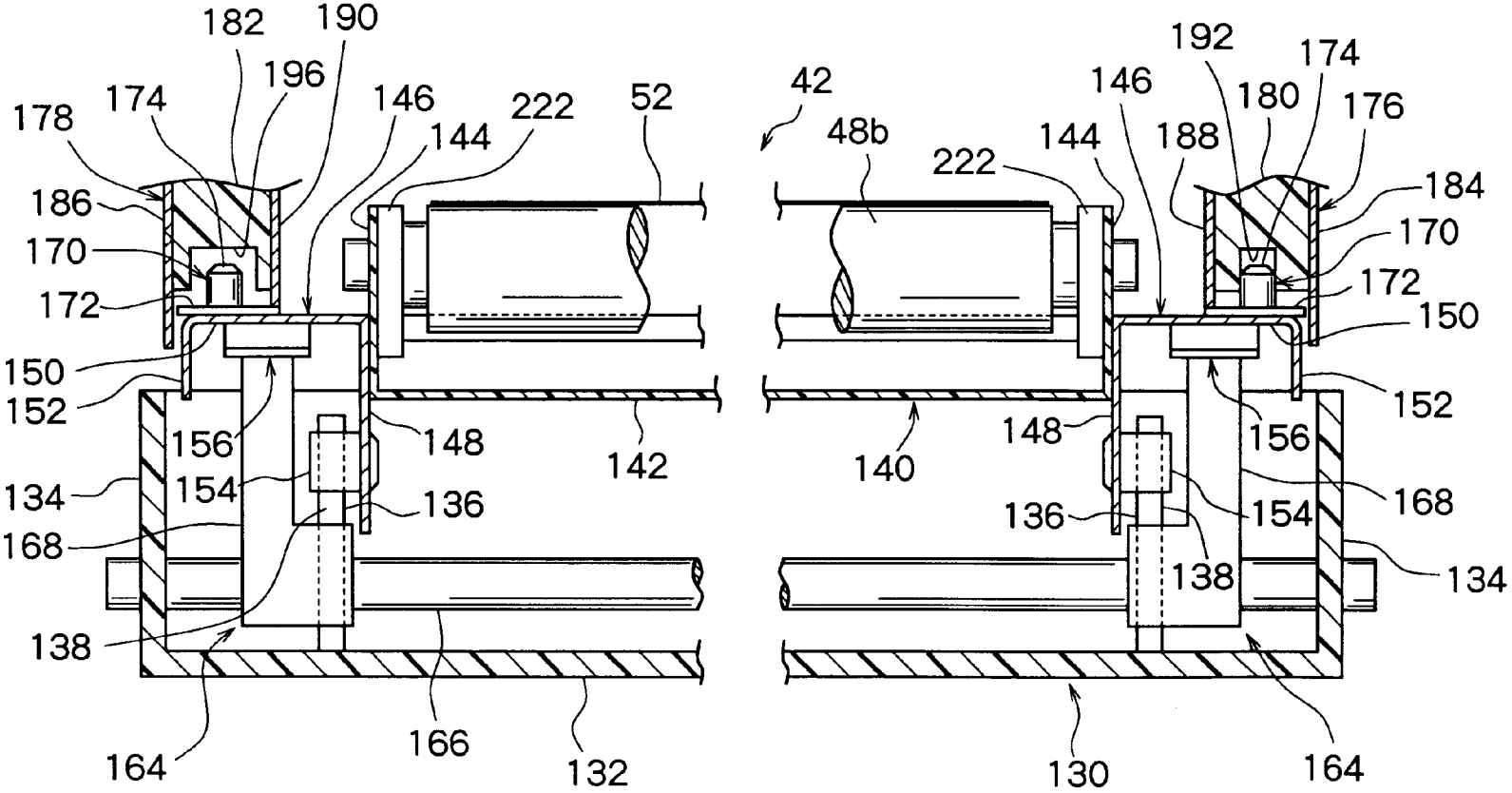
FIG. 6 is a transverse sectional view schematically illustrating a state where the transfer belt means in the image-forming machine shown in FIG. 1 is ascended to the acting position.
Figure 7:
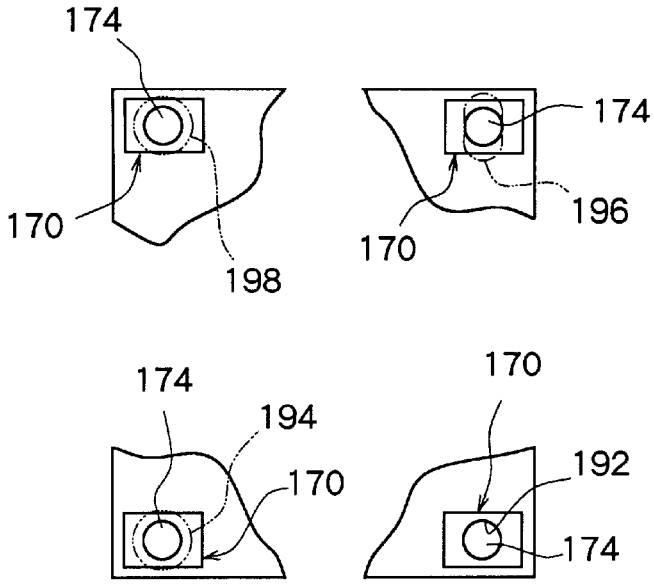
FIG. 7 is a schematic view illustrating position-restricting members disposed in the transfer belt means in the image-forming machine shown in FIG. 1.

As clearly illustrated in FIG. 6, when the lift frame 140 is ascended to the ascent position, the protruding portions 174 of the position-restricting members 170 enter into the blind receiving holes 192, 194, 196 and 198, and the upper surfaces of the base plate portions 172 come in contact with the lower edges of the inner wall portions 188 and 190. As the upper surfaces of the base plate portions 172 of the position-restricting members 170 come into contact with the lower edges of the inner wall portions 188 and 190, the ascent position of the lift frame 140 (and, hence, the transfer belt means 42) is restricted, and the lift frame 140 is resiliently held at the ascent position shown in FIG. 6 due to the resilient urging action of the resilient members 156. Therefore, the upper surfaces of the base plate portions 172 of the position-restricting members 170 constitute a contact means, the lower edges of the inner wall portions 188 and 190 constitute a to-be-contacted means, and the ascent position of the lift frame 140 (and, hence, the transfer belt means 42) is very accurately restricted by the cooperation of the contact means and the to-be-contacted means. As will be comprehended with reference to FIG. 7, among the four blind receiving holes, one blind receiving hole 192 has an inner diameter corresponding to the outer shape of the main portion of the protruding portion 174 of the position-restricting member 170, and another blind hole 196 extends in the direction of width (up-and-down direction in FIG. 7), maintaining a width corresponding to the outer shape of the main portion of the protruding portion 174 of the position-restricting member 170. Therefore, as the protruding portion 174 of the position-restricting member 170 enters into the blind receiving hole 192, a particular point (one protruding portion 174) of the lift frame 140 is accurately positioned with respect to a particular point (blind receiving hole 192) of the frame 6 of the image-forming unit 4. And, as the protruding portion 174 of the position-restricting member 170 enters into the blind receiving hole 196, the angular position of the lift frame 140 is accurately restricted with the blind receiving hole 192 as a center. Thus, the position of the lift frame 140 (or the transfer belt means 42) in the horizontal direction is accurately restricted with respect to the frame 6 of the image-forming unit 4. The blind receiving holes 194 and 198 have inner diameters larger than the outer shape of the protruding portion 174 of the position-restricting member 170. The blind receiving holes 196 and 198 as well as the protruding portions 174 of the position-restricting members 170 that enter into the blind receiving holes 196 and 198, may not be formed. In the illustrated embodiment, however, the four position-restricting members 170 have the same shape and hence, can be molded by using the same metal mold, making it possible to lower the cost of production.

If described with reference to FIG. 1 together with FIGS. 4 to 6, the support shaft 200 of the driven roller 44 in the transfer belt means 42, the support shaft 202 of the black toner image transfer roller 48*a*, and the support shaft (not shown) of the auxiliary roller 50 are directly mounted rotatably between both side walls 144 of the lift frame 140.

The support shaft 202 of the driven roller 44 is drivably coupled to a drive source 206 which may be an electric motor via a suitable drive coupling means (not shown), and the driven roller 44 (or endless belt 52) is rotated by the drive source 206 in the direction indicated by an arrow 208 in FIG. 1.

Figure 8:
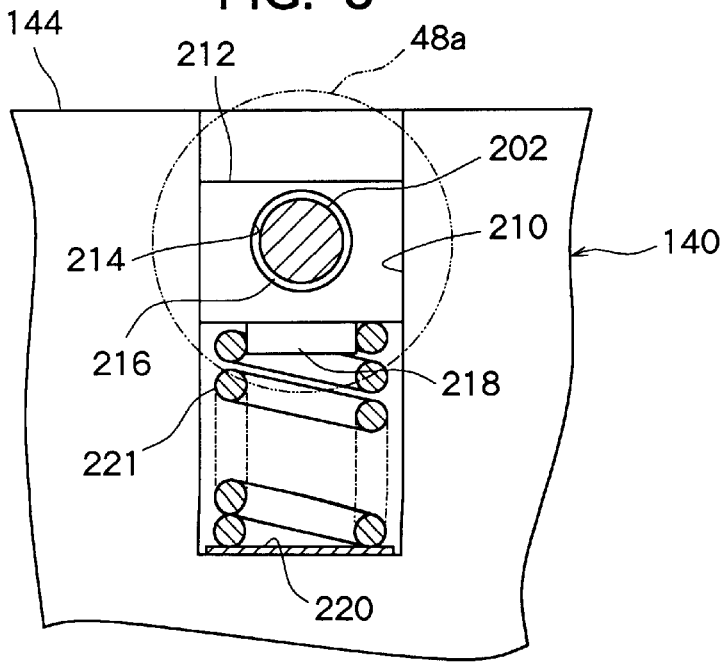
FIG. 8 is a sectional view illustrating a manner of mounting a black toner image transfer roller of the transfer belt means in the image-forming machine shown in FIG. 1.

FIG. 8 illustrates a manner of mounting the black toner image transfer roller 48*a*. Grooves 210 are formed in the inner surfaces of both side walls 144 of the lift frame 140 extending downward substantially vertically from the upper edges thereof. Bearing members 212 that are preferably formed of an electrically conducting resin are held in the grooves 210 so as to slide in the vertical direction. Through support holes 214 are formed in the bearing members 212, and the support shaft 202 is rotatably mounted in the support holes 214 via bushings 216. The bushings 216 and the support shaft 202 can be formed of a suitable electrically conducting metal. The black toner image transfer roller 48*a* which is preferably formed of a suitable electrically conducting resin such as an electrically conducting fluorine-based resin is secured to the support shaft 202. A protrusion 218 having a circular shape in cross section is formed on the lower surface of the bearing member 212. An electrode piece 220 which may be an electrically conducting metal plate is secured to the bottom surface of the groove 210 formed in the lift frame 140. A coil spring 221 is interposed between the electrode piece 220 and the bearing member 212. The upper end of the coil spring 221 surrounds the protrusion 218 formed on the lower surface of the bearing member 212. The coil spring 221 formed of an electrically conducting metal resiliently urges the bearing member 212 (or the black toner image transfer roller 48*a*) upward and electrically connects the black toner image transfer roller 48*a* to the electrode piece 220 via the support shaft 202, bushing 216 and bearing member 212. The electrode piece 220 is connected to a transfer voltage source (not shown) via a connection wire (not shown), and a required transfer voltage is applied to the black toner image transfer roller 48*a* from the above voltage source.

Figure 9:
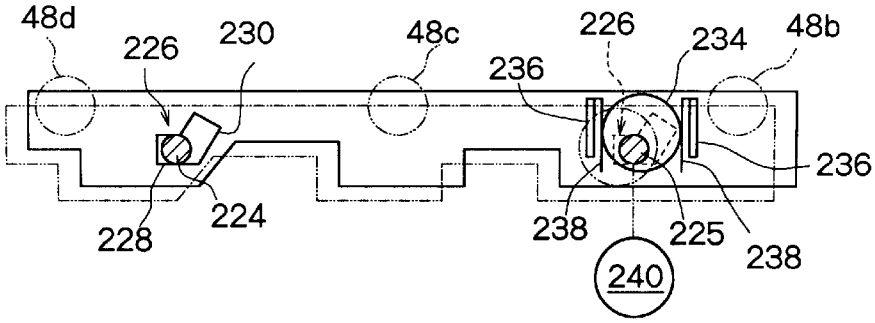
FIG. 9 is a sectional view illustrating moving members used for mounting a magenta toner image transfer roller, a cyan toner image transfer roller and a yellow toner image transfer roller of the transfer belt means in the image-forming machine shown in FIG. 1.

The magenta toner image transfer roller 48*b*, cyan toner image transfer roller 48*c* and yellow toner image transfer roller 48*d* are mounted on the lift frame 140 through a pair of moving members 222 that can be formed of a suitable synthetic resin. If described with reference to FIGS. 1 and 6 together with FIG. 9, a pair of support shafts 224 and 225 are mounted between both side walls 144 of the lift frame 140, the pair of support shafts 224 and 225 extending substantially horizontally at a distance in the direction of conveying the sheet members (right-and-left direction in FIG. 9). On the other hand, a pair of slits 226 are formed in each of the moving members 222 at a distance in the direction of conveying the sheet members. The slits 226 have a width corresponding to the outer diameter of the support shafts 224 and 225. The slit 226 has a horizontal portion 228 that extends substantially horizontally and an inclined portion 230 that extends upward from the horizontal portion in an inclined manner. The moving members 222 are mounted on the insides of both side walls 144 of the lift frame 140 with their support shafts 224 and 225 being inserted in the slits 226, and are allowed to freely move in the direction in which the slits 226 extend. A pair of eccentric disk cams 234 positioned neighboring the inner surfaces of the pair of moving members 222 are secured to the support shaft 225. A pair of protuberances 236 are formed on the inner surfaces of the pair of moving members 222 so as to be positioned on both sides of the eccentric disc cams 234. Leaf springs 238 are secured to the protuberances 236 so as to engage with the peripheral edges of the eccentric disc cams 234. The support shaft 225 is coupled to a drive source 240 which may be an electric motor, and the eccentric disk cams 234 secured to the support shaft 225 are turned between the ascent position indicated by a solid line in FIG. 9 and the descent position indicated by a two-dotted chain line in FIG. 9. When the eccentric disc cams 234 are turned to the ascent position indicated by the solid line in FIG. 9, the moving members 222 are urged toward the right in FIG. 9 as indicated by a solid line in FIG. 9 and are brought to the ascent position where the support shafts 224 and 225 are received by the horizontal portions 228 of the slits 226. When the eccentric disc cams 234 are turned to the descent position indicated by the two-dotted chain line in FIG. 9, the moving members 222 are urged toward the left in FIG. 9 as indicated by a two-dotted chain line in FIG. 9 and are brought to the descent position where the support shafts 224 and 225 are received by the upper ends of the inclined portions 230 of the slits 226.

The magenta toner image transfer roller 48*b*, cyan toner image transfer roller 48*c* and yellow toner image transfer roller 48*d* are rotatably mounted between the pair of moving members 222. The manner of mounting the magenta toner image transfer roller 48*b*, cyan toner image transfer roller 48*c* and yellow toner image transfer roller 48*d* on the pair of moving members 222 may be substantially the same as the manner of mounting the black toner image transfer roller 48*a* on both side walls 144 of the lift frame 140 described with reference to FIG. 8. To form a color image by using the image-forming machine that is illustrated, the lift frame 140 is brought to the ascent position indicated by the solid line in FIGS. 5 and 6, and the pair of moving members 222 are brought to the ascent position indicated by the solid line in FIGS. 5, 6 and 9. Then, the black toner image transfer roller 48*a*, magenta toner image transfer roller 48*b*, cyan toner image transfer roller 48*c* and yellow toner image transfer roller 48*d* work to resiliently urge the endless belt 52 upward so as to come into contact with (or brought close to) the rotary drums 28*a*, 28*b*, 28*c* and 28*d* of the image-forming means 26*a*, 26*b*, 26*c* and 26*d*. To form a black image, on the other hand, the moving members 222 are brought to the descent position indicated by a two-dotted chain line in FIG. 9, and the magenta toner image transfer roller 48*b*, cyan toner image transfer roller 48*c* and yellow toner image transfer roller 48*d* are lowered down to some extent. It is desired that the pair of moving members 222 are brought to the descent position indicated by the two-dotted chain line in FIG. 9 when the lift frame 140 is lowered to the descent position indicated by the solid line in FIG. 4.

Figure 10:
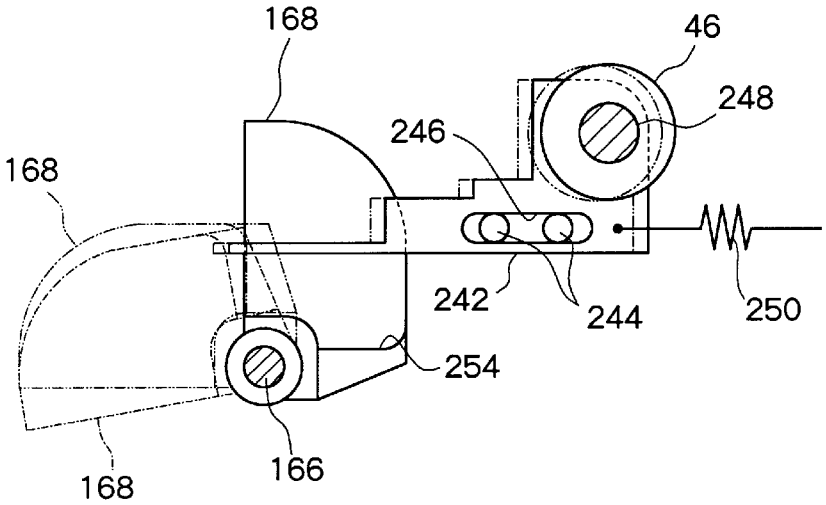
FIG. 10 is a sectional view illustrating a manner of mounting a tension roller of the transfer belt means, and a tension release means in the image-forming machine shown in FIG. 1.

Next, described below is the manner of mounting the tension roller 46. If described with reference to FIGS. 1 and 6 together with FIG. 10, the tension roller 46 in the illustrated embodiment is mounted on the lift frame 140 via a pair of moving members 242 (one of them is shown in FIG. 10). Specifically, a pair of support pins 244 are secured to the outer surfaces of both side walls 144 of the lift frame 140, the pair of support pins 244 protruding substantially horizontally at a distance in the direction of conveying the sheet members (right-and-left direction in FIG. 10). A slit 246 is formed in each of the moving members 242 extending in the direction of conveying the sheet members. The slit 246 has a width corresponding to the outer diameter of the support pin 244. Each moving member 242 has the pair of support pins 244 which are inserted in the slit 246, and is thus mounted on the lift frame 140 so as to freely move over a predetermined range in the direction in which the slit 246 extends (in the right-and-left direction in FIG. 10). The pair of moving members 242 have upwardly extending support portions, and both ends of the support shaft 248 of the tension roller 46 are rotatably mounted on the support portions of the pair of moving members 242 via suitable bearing members (not shown). Referring to FIG. 10, a resilient urging means 250 which may be a coil spring is connected at its one end to the moving member 242 and is connected at its other end to the lift frame 140. The resilient urging means 250 resiliently urges the moving member 242, i.e., the tension roller 46, toward the right in FIGS. 1 and 10, whereby a required tension is applied to the endless belt 52 of the transfer belt means 42.

Figure 11:
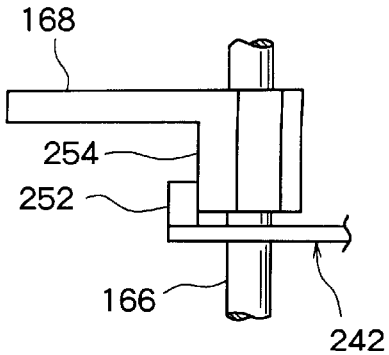
FIG. 11 is a sectional view illustrating the tension release means shown in FIG. 10.

In the illustrated embodiment constituted according to the present invention, there is provided a tension release means which, when the lift frame 140 descends, moves the tension roller 46 in a direction to no longer apply the tension, so that the tension is no longer applied to the endless belt 52. If further described with reference to FIGS. 10 and 11, each moving member 242 has a to-be-engaged means 252 constituted by a protruding piece that protrudes outward. Among the four cam members 168 of the lift means 164, furthermore, the two cam members 168 (two cam members positioned on the right side in FIGS. 5 and 6) are provided with an engaging means 254 that engages with the to-be-engaged means 252. The engaging means 254 can be constituted by a buldged portion formed integrally on one surface of the cam member 168. Referring to FIGS. 10 and 11, when the cam members 168 of the lift means 164 are turned in the counterclockwise direction in FIGS. 4 and 10 up to a position indicated by a two-dotted chain line in FIGS. 4 and 10 and by a solid line in FIG. 11, i.e., the lift frame 140 is lowered to the descent position, the engaging means 254 formed on the cam members 168 come in contact with the to-be-engaged means 252 formed on the moving members 242. Then, as the cam members 168 are further turned in the counterclockwise direction up to the descent angular position indicated by a solid line in FIG. 4 and by a dot-dash chain line in FIG. 10, the engaging means 254 urges the to-be-engaged means 252 toward the left in FIG. 10, whereby the moving members 242 (and tension roller 46) are moved leftward to a position indicated by a two-dotted chain line in FIG. 10 (and FIG. 1) against the resilient urging action of the resilient urging means 250, and the tension is no longer applied to the endless belt 52 of the transfer belt means 42. Thus, when the image-forming operation of the image-forming machine ends and the transfer belt means 42 is lowered, application of the tension to the endless bent 52 is automatically discontinued and hence, the endless belt 52 is worn out to a minimum degree.

In the illustrated embodiment constituted according to the present invention, there is further provided a tension release invalidation means which detects the manual operation for drawing out the image-forming unit 4 from the acting position in the housing 2 when the transfer belt means 42 has been descended and the tension has no longer been applied to the endless belt 52, and invalidates the action of the above-mentioned tension release means. As described already with reference to FIGS. 2 and 3, at the time when the image-forming unit 4 is to be drawn from the acting position, the operation lever 16 of the locking means 12 is, first, turned by a finger in the clockwise direction in FIG. 3, so that the hook 18 separates away from the lock pin 20 thereby to discontinue the locking action of the locking means 12. When the above-mentioned manual operation is executed to turn the hook 18 in the clockwise direction from the locking position indicated by the solid line in FIG. 3, the detector 25 detects this fact and generates a signal. When the detector 25 generates a signal in the illustrated embodiment, the drive source 170 coupled to the cam shaft 166 is energized, and the cam members 168 are turned in the clockwise direction in FIGS. 1 and 10 from the descent angular position indicated by the solid line in FIG. 4 and by the dot-dash chain in FIG. 10 up to the position indicated by the two-dotted chain line in FIGS. 4 and 10. Then, the moving members 242 are moved toward the right in FIG. 10 up to a position indicated by the solid line in FIG. 10 due to the resilient urging action of the resilient urging means 250, whereby the tension is applied to the endless belt 52 of the transfer belt means 42. When the image-forming unit 4 is drawn subsequently to the unlocking operation, therefore, the tension is still applied to the endless belt 52 of the transfer belt means 42 despite that the transfer belt means 42 has been lowered down to the non-acting position. Therefore, such an occurrence can be fully avoided that the upper running portion of the endless belt 52 swells upward due to no application of tension to the endless belt 52 and as a result, the image-forming unit 4 that is drawn out interferes with the endless belt 52 to damage it.

Though the image-forming machine constituted according to the present invention was described above in detail by way of a preferred embodiment with reference to the accompanying drawings, it should be noted that the present invention is in no way limited to the above-mentioned embodiment only but can be changed or modified in other various ways without departing from the scope of the present invention.

What is claimed is:

1. An image-forming machine comprising a housing, an image-forming unit arranged in said housing, a transfer belt means located beneath said image-forming unit and arranged in said housing so as to freely ascend and descend between an acting position where it works in cooperation with said image-forming unit and a non-acting position where it is descended from said acting position and is separated away from said image-forming unit, and a lift means for ascending and descending said transfer belt means, wherein said transfer belt means includes a lift frame which freely ascends and descends between said acting position and said non-acting position, a driven roller rotatable mounted on said lift frame, a tension roller rotatable mounted on said lift frame, an endless belt wrapped around said driven roller and said tension roller, and a resilient urging means, and wherein said tension roller is mounted on said lift frame so as to freely move in a direction in which tension is applied to said endless belt and in the opposite direction in which no tension is applied thereto, and said resilient urging means resiliently urges said tension roller toward the direction in which tension is applied to said endless belt, said image-forming machine further comprises a tension release means which, when said lift frame is descended to said non-acting position by said lift means, moves said tension roller toward a direction in which tension is no longer applied, against a resilient urging action of said resilient urging means, so that no tension is applied to said endless belt, said lift means is constituted by cam members that are mounted to freely turn between an ascent angular position at where said lift frame is ascended to said acting position and a descent angular position at where said lift frame is descended to said non-acting position, and a turn means for turning said cam members;

said lift frame is provided with moving members which move in a direction for applying tension and in a direction for discontinuing the application of tension, said tension roller is rotatably mounted on said moving members, and said resilient urging means resiliently urges said moving members toward a direction in which the tension is applied, and said tension release means is constituted by an engaging means attached to said cam members and to-be-engaged means formed in said moving members, said engaging means engage with said to-be-engaged means to move said moving members in the direction of discontinuing the application of tension while said cam members are turned from said ascent angular position to said descent angular position, and said engaging means are liberated from said to-be-engaged means while said cam members are turned from said descent angular position to said ascent angular position.

2. An image-forming machine according to claim 1, wherein a resilient member is interposed between said cam members and said lift frame, said transfer belt means is provided with contact means, said image-forming unit is provided with to-be-contacted means, and said cam members that are turned to said ascent angular position work to depress said contact means of said lift frame onto said to-be-contacted means of said image-forming means via said resilient means.

3. An image-forming machine comprising a housing, an image-forming unit arranged in said housing so as to freely move between an acting position and a non-acting position substantially horizontally drawn from said acting position, a transfer belt means located beneath said image-forming unit and arranged in said housing so as to freely ascend and descend between an acting position where it works in cooperation with said image-forming unit and a non-acting position where it is descended from said acting position and is separated away from said image-forming unit when said image-forming unit is located at said acting position, and a lift means for ascending and descending said transfer belt means;

wherein said transfer belt means includes a lift frame which freely ascends and descends between said acting position and said non-acting position, a driven roller rotatably mounted on said lift frame, a tension roller rotatably mounted on said lift frame, an endless belt wrapped around said driven roller and said tension roller, and a resilient urging means, and wherein said tension roller is mounted on said lift frame so as to freely move in a direction in which tension is applied to said endless belt and in the opposite direction in which no tension is applied thereto, and said resilient urging means resiliently urges said tension roller toward the direction in which the tension is applied to said endless belt;

wherein said image-forming machine further comprises:

a tension release means which, when said lift frame is descended to said non-acting position by said lift means, moves said tension roller toward a direction in which the tension is no longer applied, against the resilient urging action of said resilient urging means, so that no tension is applied to said endless belt; and a tension release invalidation means which detects the manual operation that is executed for drawing out said image-forming unit from said acting position when said tension release means discontinues the application of tension to said endless belt, and invalidates the tension release action of said tension release means.

4. An image-forming apparatus according to claim 3, wherein: said lift means is constituted by cam members that are mounted to freely turn between an ascent angular position at where said lift frame is ascended to said acting position and a descent angular position at where said lift frame is descended to said non-acting position, and a turn means for turning said cam members;

said lift frame is provided with moving members which move in a direction for applying tension and in a direction for discontinuing the application of tension, said tension roller is rotatably mounted on said moving members, and said resilient urging means resiliently urges said moving members toward a direction in which the tension is applied;

said tension release means is constituted by an engaging means attached to said cam members and to-be-engaged means formed in said moving members, said engaging means engage with said to-be-engaged means to move said moving members in the direction of discontinuing the application of tension while said cam members are turned from said ascent angular position to said descent angular position, and said engaging means are liberated from said to-be-engaged means while said cam members are turned from said descent angular position to said ascent angular position; and said tension release invalidation means turns said cam members toward said ascent angular position from said descent angular position by a predetermined angle, so that said engaging means are liberated from said to-be-engaged means.

5. An image-forming machine according to claim 4, wherein a resilient member is interposed between said cam members and said lift frame, said transfer belt means is provided with contact means, said image-forming unit is provided with to-be-contacted means, and said cam members that are turned to said ascent angular position work to depress said contact means of said lift frame onto said to-be-contacted means of said image-forming means via said resilient means.

6. An image-forming machine according to claim 3, wherein said lift frame freely ascends and descends in a substantially vertical direction.

7. An image-forming machine according to claim 3, wherein said image-forming unit is provided with a locking means which releasably locks said image-forming unit at said acting position, said locking means freely moves between a locking position and an unlocking position, and said tension release invalidation means detects the manual operation for moving said locking members from said locking position to said unlocking position.

* * * * *